United States Patent [19]

Ferrieri

[11] Patent Number: 4,557,513

[45] Date of Patent: Dec. 10, 1985

[54] METHOD AND APPARATUS FOR LIFTING A BLOCK

[75] Inventor: John Ferrieri, Federal Way, Wash.

[73] Assignee: The Boeing Company, Seattle, Wash.

[21] Appl. No.: 598,865

[22] Filed: Apr. 11, 1984

[51] Int. Cl.[4] ..... B66C 1/10

[52] U.S. Cl. ..... 294/1.1; 294/82.1; 294/89; 403/3; 411/383

[58] Field of Search ..... 294/1 R, 2, 15, 78 R, 294/78 A, 82 R, 86 R, 89; 16/114 R, 124–127; 403/3, 174; 411/378, 383, 548

[56] References Cited

U.S. PATENT DOCUMENTS

| | | | |
|---|---|---|---|
| 3,371,951 | 3/1968 | Bryant | 294/89 X |
| 3,492,033 | 1/1970 | Mueller | 294/82 R X |
| 4,139,179 | 2/1979 | Kukulski | 294/78 A X |
| 4,223,932 | 9/1980 | Gonsalves | 294/1 R |

FOREIGN PATENT DOCUMENTS

| | | | |
|---|---|---|---|
| 2016564 | 10/1970 | Fed. Rep. of Germany | 294/89 |
| 301542 | 6/1968 | Sweden | 294/89 |

*Primary Examiner*—Johnny D. Cherry
*Attorney, Agent, or Firm*—Hughes & Cassidy

[57] ABSTRACT

A lifting device adapted to lift an object, such as a metal block, having a threaded socket for engagement of a lifting device. The lifting device comprises a ring, to which is rotatably mounted a hub having three outwardly extending threaded studs of different sizes. The appropriate stud, having a diameter matching that of the socket of the object to be lifted, can be moved into the lifting position for threaded engagement with the socket.

6 Claims, 4 Drawing Figures

METHOD AND APPARATUS FOR LIFTING A BLOCK

BACKGROUND OF THE INVENTION

1. Field of the Invention

The present invention relates to a method and apparatus of lifting an object, such as a metal block, and more particularly to such an apparatus adapted to lift a block having a threaded socket of a predetermined diameter formed therein for attachment to a lifting device.

2. Background Art

In a manufacturing operation, quite often when metal is to be machined into a particular configuration, the metal to be machined is provided in the form of a block (many times in the configuration of a rectangular prism). Since such blocks can each weigh several hundred pounds or more, it is necessary to provide some convenient means for lifting these blocks, and this is commonly done by forming in the block a threaded socket of a predetermined diameter. To lift the block, there is provided a connecting device in the form of a lift ring. The lift ring is commonly made in the form of a loop that is adapted to be connected to the hook of a crane, and attached to this loop is a threaded stud which can be threaded into the lifting socket of the block.

Normally, the person who is arranging for the block to be lifted selects a lifting ring having a threaded stud with a diameter matching that of the socket in the block. The stud is threaded into the socket so that the lift ring is properly secured to the object. Then the lifting operation can be accomplished quite simply by connecting the crane's hook to the loop of the lift ring.

For many years, one of the problems in conducting this operation is that the lifting sockets formed in the block are of different diameters. For example, if the block is somewhat heavier, the socket may be made somewhat larger to accommodate a larger threaded stud. If this person happens to select a ring having a stud of the wrong diameter, it sometimes happens that he tries to force the threaded stud of the wrong size into the socket, in the hopes that there will be sufficient engagement to accomplish the lifting action. Also, it sometimes happens that the lift ring having the stud of the appropriate size has been mislaid or is otherwise not available. Rather than delay lifting the block entirely, or using some other method of lifting the block, a lift ring with a stud of the wrong size is sometimes used as a poor compromise.

One of the problems in this improper matching of the threaded stud and socket is that threads on the stud of the lift ring become damaged, making it more difficult to use the lift ring in situations where the threaded stud does match the socket. This further complicates matters in that the person selecting the particular lift ring is not always sure whether a ring with a stud of the wrong diameter has been selected or whether the threaded stud, even though of the proper size, is difficult to thread into the socket because the threads are damaged to some extent.

The net result is that an improper connection is sometimes made between the lift ring and the object to be lifted. In a manufacturing operation, this can be a potential safety hazard. To the best knowledge of the applicant, the problems inherent in this lifting operation have existed many years. The prior art approaches to alleviate this problem have been, to the best knowledge of the applicant, precautionary, such as insuring that lift rings having the studs of the proper size are readily available. Further, reminders and warnings to the workers are placed in the work area that they should be careful that the attachment of the lift ring is properly made prior to lifting. However, in spite of the many precautions taken in manufacturing operations, the state of the art relative to the mechanics of lifting such blocks has not advanced to a state where this hazard could be substantially alleviated.

A search of the U.S. patent literature has turned up substantially nothing of any real relevance to the problems noted above, and U.S. Pat. No. 2,339,594, Goldberg et al, was the only patent cited in the report of the search conducted. This patent shows an adjustable pipe hanger where pipes of different size can be held in the hanger. Clamping bars having different arcuate configurations are provided to accommodate pipes of different diameter.

Accordingly, it is an object of the present invention to provide a method and apparatus to alleviate at least to some extent the problems noted above. It is a further object to provide a lift ring apparatus which can be used conveniently and effectively, and which provides for a more efficient operation, in addition to enhancing the safety of the operation.

SUMMARY OF THE INVENTION

The present invention is a method and apparatus of lifting an object having a thread socket for engagement of a studded male member for lifting the object. There is initially provided a lifting device comprising first and second connecting members. The first connecting member has a first connecting portion adapted to be connected to a lifting mechanism, such as a hook of a crane.

The second connecting member is selectively positionable relative to the first connecting member, and it comprises a plurality of threaded studs. Each stud has a predetermined diameter differing from another of said studs, with the studs being movably connected to the first connecting member in a manner that each of said studs can be selectively positioned in a lifting location.

In the method of the present invention, there is selected one of the studs having a diameter matching a diameter of the threaded socket of the object to be lifted. This selected stud is positioned in a lifting position relative to the lifting device and the stud is threaded into the socket of the object. Then a lifting mechanism is attached to the connecting portion and the object is moved by a force applied to the lifting device to the object.

More specifically, the second connecting member of the lifting device comprises a hub rotatably connected to the first connecting member about an axis of rotation, and the studs are connected to the hub so as to extend radially outwardly from the axis of rotation. The method further is characterized in that the selected stud is positioned at the selected location by rotating the hub about the axis of rotation.

More specifically, the first connecting member comprises a connecting loop spaced from the axis of rotation. The method further comprises positioning the selected stud in a connecting position by aligning an axial centerline of the selected stud with the axis of rotation and with the connecting loop.

Further, the lifting device has a retaining member interacting between the first and second connecting members. After the stud is threaded into the socket of the object to be lifted, the loop is maintained in an upright position by the retaining member holding the loop in place.

In the preferred form of the lifting device, the first connecting member, in addition to comprising a loop, comprises a pair of legs, with each leg having one end portion connecting to the loop, and a second end portion positioned one side of the hub. Pin means extend between the second end portions of the two legs, with the hub being mounted to said pin means for rotation about the axis of rotation. In the specific embodiment shown, there are at least three studs, each having a different diameter and mounted at spaced locations around the hub.

In the preferred form, the retaining means comprises three retaining devices, each of which comprises a retaining element positioned in a related socket of the second connecting member. There is a compression spring in the socket urging the retaining element outwardly into an engaged position, so that the retaining element engages the first connecting member in retaining engagement. More specifically, each retaining member comprises a ball and detent retaining device, where the ball is in retaining element, and the detent is formed in an inner surface of one of the legs of the connecting member.

Other features of the present invention will become apparent from the following detailed description.

BRIEF DESCRIPTION OF THE PREFERRED EMBODIMENT

Figure 1:
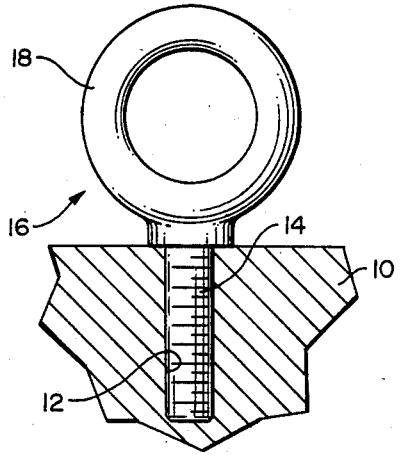
FIG. 1 PRIOR ART
FIG. 1 is a side elevational view, partially in section, illustrating a prior art hoist ring connected to a block in preparation for lifting the block.

It is believed that a clearer understanding of the present invention will be obtained by first examining, with reference to FIG. 1, a common prior art device used in lifting a block or other object. There is shown in section a portion of a metal block 10 having a threaded socket 12 to receive a threaded stud 14 of a lift ring or hoist ring 16. Connected to the threaded stud 14 is a circular loop 18, adapted to receive a hook or other attaching device of a crane.

As indicated previously in the discussion of background art, one of the long existing problems with this type of hoist ring 16 is that the sockets 12 have diameters of different dimensions of, for example, $\frac{3}{8}$ inch, $\frac{1}{2}$ inch, or $\frac{3}{4}$ inch. Accordingly, a number of hoist rings 16 are provided. While the necessity of having several types of lift rings is not any insurmountable inconvenience, as indicated above the concern is that there are certain related safety hazards. For example, when the threaded stud portion 14 is of the wrong size, it sometimes happens that a worker will attempt to force the threaded stud 14 into engagement with the socket 12, particularly where the lift is going to be of very short duration. Or, it may happen that the worker thinks that the threaded stud 14 is of the right size, but that the threads do not have a good fit. Accordingly, the worker may attempt to force the stud 14 into threaded engagement. The overall effect is that in some instance the threaded connection is damaged, and in other instances, an improper connection is made which constitutes a safety hazard.

Figure 4:
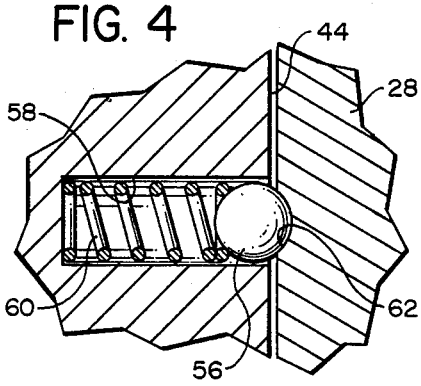
FIG. 4 is a sectional view, drawn to enlarged scale, showing one of the locating ball locks of the present invention.
Figure 2:
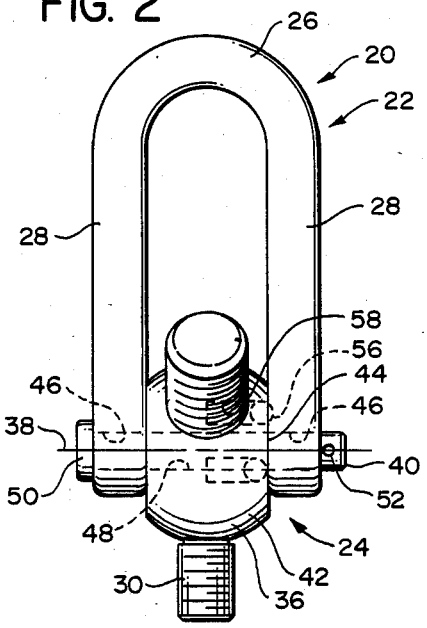
FIG. 2 is a front elevational view of the lift ring of the present invention.
Figure 3:
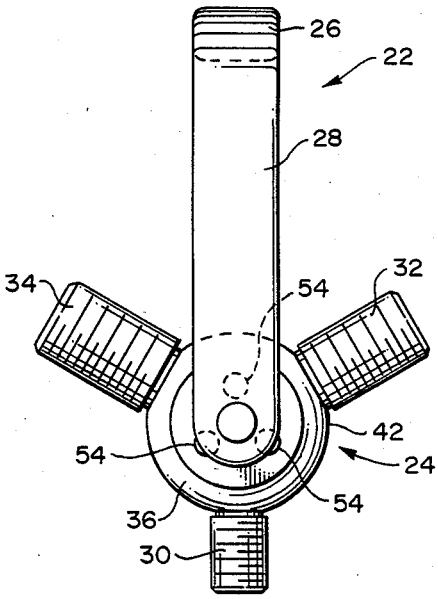
FIG. 3 is a side elevational view thereof.

The hoist ring of the present invention, generally designated 20, is illustrated in FIGS. 2–4. In general, this lift ring 20 comprises first and second connecting portions 22 and 24, respectively. The connecting portion 22 has a generally U-shaped configuration, comprising a loop 26 and two legs 28 made integral with the loop 26. The overall U-shaped configuration of the first connecting portion 22 is or may be of conventional design.

The second connecting portion 24 comprises three threaded stud connectors 30, 32, and 34, respectively. In the particular embodiment shown herein, the stud connector 30 has a diameter of $\frac{3}{8}$ inch; the stud connector 32 a diameter of $\frac{1}{2}$ inch; and the stud connector 34 a diameter of $\frac{5}{8}$ inch. These three stud connectors are connected by their base ends to a hub 36 that is rotatably mounted about its center transverse axis 38 to a retaining pin 40. The axial centerline of each of the stud connectors 30, 32 and 34 extends in a direct line in a radially outward direction from the center axis 38. Further, the axis 38 lies in the same plane as that occupied by the loop 26 and legs 28 of the first connecting member 22. Thus, when any one of the stud connectors 30, 32 or 34 is positioned in a downward direction (i.e. away from the loop 26), the loading on the downwardly directed stud is in a direct line through the axis 38 to the loop 26.

As shown herein, the hub 36 has an outer peripheral surface 42, formed in a somewhat rounded configuration, and two lateral flat surfaces 44 which are in close proximity to the inside surfaces of the lower ends of the legs 28. The pin 40 can be of conventional design, and it extends through aligned openings 46 in the lower ends of the legs 28 and a through opening 48 formed in the hub 36. To retain the pin 40 in place, it is formed with an enlarged head 50 and is held in place of the opposite end by a retaining pin 52.

The second connecting member 24, made up of the hub 36 and the three stud connectors 30, 32, and 34, is freely rotatable about the pin 40. However, so that any one of the three studs 30–34 can be properly retained in its connecting position, there are provided three releasable retaining members 54. Each of these retaining members (one of which is shown in more detail in FIG. 4) comprises a ball member 56 positioned in a socket 58 formed in one side surface 44 of the hub 36, with the axis of the socket being parallel to the transverse hub axis 38. Each ball 56 is urged by a compression spring 60 outwardly from the socket 58. The leg 28 adjacent the socket 58 is formed with a small detent 62 to receive the ball 56. Each retaining member 54 is positioned so as to be aligned with the axis of rotation 38 and also aligned with the axial centerline of its related stud 30, 32 or 34. Thus, when any one of the retaining members 54 is in its engaged position (i.e. with its ball 56 engaging the detent 62), its related stud 30–34 is in its connecting position.

To describe the operation of the present invention, let it be assumed that there is a block (such as that shown at 10 in FIG. 1) is to be lifted. The threaded socket 12 and the block 10 is examine to determine its diameter, and then the connecting stud 30–34 having a matching diameter is moved to the downwardly extending connecting position. In the drawing of FIG. 3, the $\frac{3}{8}$ inch diameter stud 30 is shown in the downwardly extending connecting position.

Then, the stud 30 is threaded into the threaded socket 12 in a conventional manner. When the stud 30 has been threaded in a sufficient distance so as to insure that there is a proper lifting connection, a hook from a crane can be inserted into the loop 26 in a conventional manner. With the retaining member 54 holding the first connecting member 22 in the upright position, the connection of the hook is facilitated. Then the lifting operation can take place in a conventional manner, by applying a lifting force through the loop 26. The lifting force is directed in a straight line through the axis 38 and through the lengthwise axis of the stud 30.

When the lifting operation is completed and the block 10 is placed on a surface, the crane's hook is removed from the loop 26. At this time, the retaining member 54 still holds the loop-like first connecting portion 22 in its upwardly extending position, so that it does not fall against the surface of the block, thus avoiding possible abrasion of the surface of the block 10.

It is to be understood that while the method and apparatus of the present invention have been described relative to a metal block 10, there could also be application for lifting other items, such as lathe chucks, machine fixtures, spindles, electric motors, or other objects where single point axial loading occurs. Also, it is to be understood that various modifications could be made without departing from the basic teachings of the present invention.

I claim:

1. A lifting device adapted to lift an object having a threaded socket for attachment to a threaded male member, said device comprising:

a. a first connecting member having a first connecting portion adapted to be connected to a lifting mechanism such as a hook of a crane;

b. a second connecting member comprising:

(1) a hub portion connected to the first connecting member at a location spaced from the connecting portion for rotation about a first axis;

(2) a plurality of threaded studs, each of which is connected to said hub, with a longitudinal center axis of each said extending radially outwardly from said first axis of rotation;

(3) said hub and said studs being selectively rotatable relative to said first connecting member so that a selected one of said studs can be positioned in a lifting location, with each of said studs having a predetermined diameter differing from another of said studs;

c. said connecting portion of the first connecting member comprising a loop, said loop being positioned in said device so that with a selected one of said studs in said lifting location, the longitudinal center axis of the stud is aligned through the axis of rotation and with the loop, said first connecting member further comprising a pair of legs, with each leg having one end portion connecting to said loop, and a second end portion positioned on one side of the hub, pin means extending between the second end portions of the two legs, said hub being mounted to said pin means for rotation about the axis of rotation;

d. said device futher comprising retaining means interacting between said first and second connecting members arranged to hold each of said studs in its lifting position, with said retaining means comprising a plurality of retaining devices, each of which comprises a retaining element positioned in a related socket of the second connecting member, with compression spring means in the socket urging said retaining element outwardly into an engaged position, said retaining element engaging the first connecting member in retaining engagement at a retaining location;

whereby, depending upon the diameter of the threaded socket of the object to be lifted, a stud having an appropriate matching diameter can be utilized to lift the object.

2. The device as recited in claim 1, wherein each retaining member comprises a ball and detent retaining device, wherein the ball is the retaining element, and the detent is formed in an inner surface of one of said legs of the first connecting member.

3. A lifting device adapted to lift an object having a threaded socket for attachment to a threaded male member, said device comprising:

a. a first connecting member having a first connecting portion adapted to be connected to a lifting mechanism such as a hook of a crane;

b. a second connecting member comprising:

(1) a hub portion connected to the first connecting member at a location spaced from the connecting portion for rotation about a first axis;

(2) a plurality of threaded studs, each of which is connected to said hub, with a longitudinal center axis of each stud extending radially outwardly from said first axis of rotation;

(3) said hub and said studs being selectively rotatable relative to said first connecting member so that a selected one of said studs can be positioned in a lifting location, with each of said studs having a predetermined diameter differing from another of said studs;

c. said device further comprising retaining means interacting between said first and second connecting members arranged to hold each of said studs in its lifting position, said retaining means comprising a plurality of retaining devices, each of which comprises a retaining element positioned in a related socket of the second connecting member, with compression spring means in the socket urging said retaining element outwardly into an engaged position, said retaining element engaging the first connecting member in retaining engagement at a retaining location;

whereby, depending upon the diameter of the threaded socket of the object to be lifted, a stud having an appropriate matching diameter can be utilized to lift the object.

4. A lifting device adapted to lift an object having a threaded socket for attachment to a threaded male member, said device comprising:

a. a first connecting member having a first connecting portion adapted to be connected to a lifting mechanism such as a hook of a crane;

b. a second connecting member comprising:

(1) a hub portion connected to the first connecting member at a location spaced from the connecting portion for rotation about a first axis;

(2) a plurality of threaded studs, each of which is connected to said hub, with a longitudinal center axis of each stud extending radially outwardly from said first axis of rotation;

(3) said hub and said studs being selectively rotatable relative to said first connecting member so that a selected one of said studs can be positioned in a lifting location, with each of said studs having a predetermined diameter differing from another of said studs;

c. said connecting portion of the first connecting member comprising a loop, said loop being positioned in said device so that with a selected one of said studs in said lifting location, the longitudinal center axis of the stud is aligned through the axis of rotation and with the loop, said first connecting member further comprising a pair of legs, with each leg having one end portion connecting to said loop, and a second end portion positioned on one side of the hub, pin means extending between the second end portions of the two legs, said hub being mounted to said pin means for rotation about the axis of rotation;

d. said studs comprising at least three studs, each having a different diameter and mounted at spaced locations around said hub;

e. said device further comprising retaining means interacting between said first and second connecting members arranged to hold each of said studs in its lifting position, said retaining means comprising three retaining devices, each of which comprises a retaining element positioned in a related socket of the second connecting member, with compression spring means in the socket urging said retaining element outwardly into an engaged position, said retaining element engaging the first connecting member in retaining engagement at a retaining location;

whereby, depending upon the diameter of the threaded socket of the object to be lifted, a stud having an appropriate matching diameter can be utilized to lift the object.

5. The device as recited in claim 4, wherein each retaining member comprises a ball and detent retaining device, wherein the ball is the retaining element, and the detent is formed in an inner surface of one of said legs of the first connecting member.

6. A lifting device adapted to lift an object having a threaded socket for attachment to a threaded male member, said device comprising:

a. a first connecting member having a first connecting portion adapted to be connected to a lifting mechanism such as a hook of a crane;

b. a second connecting member comprising:

(1) a hub portion connected to the first connecting member at a location spaced from the connecting portion for rotation about a first axis;

(2) a plurality of threaded studs, each of which is connected to said hub, with a longitudinal center axis of each stud extending radially outwardly from said first axis of rotation;

(3) said hub and said studs being selectively rotatable relative to said first connecting member so that a selected one of said studs can be positioned in a lifting location, with each of said studs having a predetermined diameter differing from another of said studs;

c. said device further comprising retaining means interacting between said first and second connecting members arranged to hold each of said studs in its lifting position, said retaining means comprising three retaining devices, each of which comprises a retaining element positioned in a related socket of the second connecting member, with compression spring means in the socket urging said retaining element outwardly into an engaged position, said retaining element engaging the first connecting member in retaining engagement at a retaining location;

whereby, depending upon the diameter of the threaded socket of the object to be lifted, a stud having an appropriate matching diameter can be utilized to lift the object.

* * * * *